US005651841A

United States Patent [19]

Moro et al.

[11] Patent Number: 5,651,841

[45] Date of Patent: Jul. 29, 1997

[54] POWDER MAGNETIC CORE

[75] Inventors: Hideharu Moro; Naoki Kawakubo; Hideaki Sone; Hidetoshi Suzuki, all of Chiba, Japan

[73] Assignee: TDK Corporation, Tokyo, Japan

[21] Appl. No.: 504,418

[22] Filed: Jul. 20, 1995

[30] Foreign Application Priority Data

Jul. 22, 1994 [JP] Japan ..... 6-192207

[51] Int. Cl.[6] ..... H01F 1/24

[52] U.S. Cl. ..... 148/309; 252/62.54; 252/62.55

[58] Field of Search ..... 148/309; 252/62.54, 252/62.55

[56] References Cited

U.S. PATENT DOCUMENTS

| | | | |
|---|---|---|---|
| 4,177,089 | 12/1979 | Bankson | 148/309 |
| 4,502,982 | 3/1985 | Horie et al. | 252/513 |

FOREIGN PATENT DOCUMENTS

| | | |
|---|---|---|
| 60-74601 | 4/1985 | Japan . |
| 61-154014 | 7/1986 | Japan . |
| 62-21041 | 5/1987 | Japan . |
| 62-247004 | 10/1987 | Japan . |
| 62-247005 | 10/1987 | Japan . |
| 62-250607 | 10/1987 | Japan . |
| 3-46521 | 7/1991 | Japan . |
| 3-291305 | 12/1991 | Japan . |

OTHER PUBLICATIONS

Japan Electronic Materials Society, 31st Autumn Conference Summaries, pp. 126–130, Nov. 1 and 2, 1994, N. Kawakubo, et al., "Low Loss Powder Magnetic Core".

*Primary Examiner*—John Sheehan

*Attorney, Agent, or Firm*—Oblon, Spivak, McClelland, Maier & Neustadt, P.C.

[57] ABSTRACT

A powder magnetic core having reduced core losses and increased mechanical strength is provided at low costs. The core is obtained by compressing a ferromagnetic metal powder and an insulating agent and then annealing the compressed body. The ferromagnetic metal powder is made up of a substantially spherical form of ferromagnetic metal particles containing Fe, Al and Si. The core has a permeability of at least 50 at 100 kHz, a core loss of up to 450 kW/m$^3$ at 100 kHz in an applied magnetic field of 100 mT, and a core loss of up to 300 kW/m$^3$ at 25 kHz in an applied magnetic field of 200 mT.

9 Claims, 2 Drawing Sheets

500 μm

500 μm

100 μm

POWDER MAGNETIC CORE

BACKGROUND OF THE INVENTION

1. Field of the Invention

The present invention relates to a powder magnetic core used with various electric and electronic devices.

2. Prior Art

Recently, there is a growing requirement, in the construction of very compact electric and electronic devices, for very compact, greatly efficient powder magnetic cores. Powder magnetic cores fabricated by the compression of iron base ferromagnetic metal powders have large saturation magnetizations and so are favorable for size reductions. Sendust (Fe-Al-Si alloy) powder magnetic cores are lower in material cost than molybdenum permalloy (Fe-Ni-Mo alloy) powder magnetic cores, but they are in no sense superior to the permalloy cores in terms of permeability and power losses. Difficulty is involved in reducing the size of sendust cores used with choke coils or inductors, because large core losses result in some considerable core temperature rise. For instance, when a certain sendust powder magnetic core is built in a power supply portion of an inductor in a power-factor improving circuit, the core loss at 100 kHz and 100 mT, for example, must be reduced to preferably 450 kW/m$^3$ or less, more preferably 300 kW/m$^3$ or less.

For instance, some proposals have been made of loss reductions for sendust powder magnetic cores, as mentioned just below.

JP-B 62(1987)-21041 alleges that an iron-silicon-aluminum base magnetic alloy powder magnetic core higher in permeability and yet lower in core losses than molybdenum permalloy cores is obtainable by annealing an iron-silicon-aluminum base magnetic alloy ingot at 700° to 1,100° C., then pulverizing and pressing the annealed product, and finally firing the powder compact at 600° to 800° C. in a hydrogen atmosphere. One example in this publication shows that a powder magnetic core having a permeability of 146 at 10 kHz and core losses as measured at 25 kHz of 158 kW/m$^3$ at 1,000G and 548 kHz/m$^3$ at 2,000G is obtained by regulating the powders to 32 meshes or less, pressing them, and firing the pressed compact at 700° C.

For an inductor used with power-factor improving or other circuits, however, it is still desired to achieve further core loss reductions.

In view of the problem as above described, an object of the present invention is to provide a powder magnetic core having low core losses at low costs. Another object of the present invention is to provide a powder magnetic core having low core losses, and high mechanical strength as well.

SUMMARY OF THE INVENTION

According to the present invention, these objects are achieved by the provision of a powder magnetic core obtained by compressing a ferromagnetic metal powder and an insulating agent and then annealing the resulting compressed body, wherein said ferromagnetic metal powder is made up of a substantially spherical form of ferromagnetic metal particles including iron, aluminum and silicon.

Preferably, said ferromagnetic metal particles have a weight mean particle diameter $D_{50}$ of 15 to 65 μm, as determined by a cumulative undersize distribution method. Furthermore in this case, it is preferable that said ferromagnetic metal particles have a weight mean particle diameter $D_{10}$ of 6 to 20 μm and a weight mean particle diameter $D_{90}$ of 25 to 100 μm, as determined by a cumulative undersize distribution method.

Preferably, lattice strains induced in the ferromagnetic metal particles contained in the powder magnetic core are up to 10%.

Preferably, the coercive force of the ferromagnetic metal particles contained in the powder magnetic core is up to 0.35 Oe.

Preferably, said powder magnetic core has a permeability of at least 50 at 100 kHz, a core loss of up to 450 kW/m$^3$ at 100 kHz in an applied magnetic field of 100 mT, and a core loss of up to 300 kW/m$^3$ at 25 kHz in an applied magnetic field of 200 mT.

Preferably, the ferromagnetic metal powder has been produced by gas atomization.

Preferably, the insulating agent is a mixture of silicone resin and organic titanate.

When said mixture is used as the insulating agent, it is preferable that the annealing temperature is 500° to 800° C.

Preferable, the substantially spherical form of ferromagnetic metal particles are free from any acute-angle portion of up to 30°.

BENEFITS OF THE INVENTION

Pulverized powders have so far been used for Fe-Al-Si alloy powders for powder magnetic core production. Upon annealed, compressed, and again annealed, the powders are allowed to have low coercive force and so low hysteresis losses because they are released from stresses induced by pulverization and compression. With this technique, however, it is difficult to achieve cost reductions because annealing must be done twice. In addition, no sufficient stress release is achieved even by repeating the annealing step twice, so rendering it difficult to make coercive force and hence hysteresis losses sufficiently low. According to the present invention, on the other hand, virtually spherical Fe-Al-Si alloy powders obtained as by gas atomization are compressed and annealed. The substantially spherical Fe-Al-Si alloy powders produced as by gas atomization are more likely to liberate stresses by post-compressing annealing than the pulverized powders. As can be understood from the examples given later, the cores of the present invention are obtained by the compression and annealing of the Fe-Al-Si alloy powders produced by gas atomization, yet they are lower in coercive force and hysteresis losses than cores produced by annealing the pulverized powders and compressing them, followed by re-annealing. In other words, the present invention enables powder magnetic cores having low losses to be obtained at low costs.

Moreover, eddy-current losses can be reduced by regulating the weight mean particle diameter $D_{50}$ and particle size distribution of the ferromagnetic metal powders to the ranges as defined above.

JP-A 62(1987)-250607 discloses a method for producing Fe-Si-Al base alloy powder magnetic cores. Powders for this method are obtained by the gas atomization of an Fe-Si-Al base alloy melt to prepare spherical coarse powders and the pulverization of the coarse powders into powders having a mean particle size of 40 to 110 μm and an apparent density of 2.6 to 3.8 g/cm$^3$. The reason the spherical coarse powders obtained by gas atomization are pulverized is to obtain powders having the above given particle size in an inexpensive manner. Referring to the benefits of the invention, the specification alleges that the frequency characteristics of permeability are improved with an increase in the strength of the compressed body. The method disclosed in the specification is similar to the method of the present invention in that Fe-Si-Al base alloy powders are produced by gas atomization. With this method, however, it is impossible to reduce hysteresis losses because stresses are induced in the powders by the pulverization of the coarse powders obtained by gas atomization. It is here to be noted that the invention set forth in the specification does not aim at reducing core losses, as can be understood from the example where no core losses are measured at all.

JP-A 60(1985)-74601 discloses a powder magnetic core obtained by forming under pressure metal magnetic powders prepared by gas atomization. Referring to the benefits of the invention, the specification alleges that by use of gas atomization conventional processes can be greatly curtailed; so metal magnetic powders can be obtained by a simple process, resulting in some considerable cost reductions. However, the specification says nothing about using sendust for metal magnetic powders, and the example disclosed therein refers merely to a powder magnetic core consisting of molybdenum permalloy (an Fe-Ni-Mo alloy). Moreover, the example is silent about what temperature the compact is heat treated at, but any high-temperature treatment is unfeasible because water glass is used as an insulating agent. Nor does the specification refer to core losses.

JP-B 3(1991)-46521 discloses a method for producing an iron-silicon-aluminum base alloy powder magnetic core characterized in that magnetic alloy powders composed predominantly of iron, silicon and aluminum are formed upon the addition of water glass and 1 to 5 wt % of moisture thereto. Referring to the benefits of the invention, the specification alleges that the ability of the powders to be formed by pressing is improved with increases in permeability and in the strength of the compressed body. The specification also states that magnetic alloy powders are produced by the pulverization of an alloy obtained by melting. No satisfactory core loss reduction is achieved, as can be seen from the example showing a core loss of 500 $kW/m^3$ or more at 25 kHz and 2,000G. It is here to be noted that while the example set forth in the specification teaches the firing of the compact at 750° C. after pressing, the experiments conducted by the inventors indicated that the water glass, when used as an insulating agent, is decomposed at a temperature as high as 750° C., making it impossible to maintain insulation among alloy particles and so resulting in a considerable increase in eddy-current losses.

In one preferable embodiment of the present invention, a mixture of silicone resin and organic titanate is used as an insulating agent for the compression of ferromagnetic metal powders. The silicone resin excels in insulating properties, and is of high heat resistance as well. Due to these properties, even when the ferromagnetic metal powders are annealed at high temperature, it is possible to maintain good-enough insulation among the ferromagnetic metal particles, so that an increase in eddy-current losses and degradation of the frequency characteristics of permeability can be avoided. An Fe-Al-Si alloy composed predominantly of sendust has a BCC structure and, lust after produced, takes a $B_2$ structure comprising a random texture of Al and Si. Upon annealed at high temperature, however, this structure is transformed into a $DO_3$ structure having a superlattice comprising an alternate texture of Al and Si, so that soft magnetism can be enhanced. The high-temperature annealing is also well effective for releasing the ferromagnetic metal powders from stresses, so that the coercive force can be reduced. The silicone resin is, on the other hand, cured by annealing, so that the mechanical strength of the core can be increased. The organic titanate behaves as a crosslinking agent for the silicone resin. By use of the organic titanate the mechanical strength of the core can be much more increased.

JP-A 61(1986)-154014 discloses a powder magnetic core formed of a compressed body of magnetic powders, using as a binder an inorganic polymer that is an electrical insulator. The example set forth therein teaches that amorphous alloy powders are dipped in a solution of the inorganic polymer or polysiloxane resin and shaped into a ring form of core, and the core is then heat treated at 150° C. for 20 minutes and at 250° C. for a further 30 minutes to remove the solvent and finally heat treated at 420° C. for 60 minutes for the curing of the resin. The method disclosed in the specification is distinguishable from the present invention in that the former uses an inorganic polymer while the latter makes use of silicone resin and organic titanate. For this reason, the core fabricated by the method disclosed in the above specification is inferior in mechanical strength to the core according to the present invention.

JP-A 62(1987)-247004 discloses a method for making a metal powder magnetic core comprising the steps of coating the surface of a metal magnetic powder with an organometallic coupling agent that contains a metal capable of forming an insulating oxide, mixing the thus treated powder with a binder in the form of synthetic resin, forming the mixture under pressure, and heat treating the compressed body, thereby forming an insulating metal oxide coating. The coupling agent disclosed therein includes silane, titanium, and chromium base coupling agents containing metals capable of forming insulating oxides, for instance, $SiO_2$. The specification states that if a resin capable of reacting with the organic functional group in the molecule of the coupling agent is used as the binder, the uniform coating of the metal powders with the resin is achieved so that the ability of the metal powders to be compressed can be improved, and says that in the process during which the compressed body is heat treated for removal of strains induced by compression, the functional group is scattered off at 200° to 300° C. so that an insulating oxide coating of excellent heat resistance can be formed; that is, the permeability of the core can be enhanced by a heat treatment occurring at a temperature higher than would be possible in the prior art. In the example set forth in the specification, the alloy powders are treated with an aqueous solution of γ-aminopropyl triethoxy silane, and dried. The thus treated powders are homogeneously mixed with epoxy resin, and the mixture is heat treated at 500° to 900° C. upon compressed. With this method in contrast to the present invention that makes use of silicone resin and organic titanate, it is impossible to improve interparticle insulation and the mechanical strength of the core at the same time, because an oxide coating is obtained.

JP-A 62(1987)-247005 discloses a method for making a metal powder magnetic core comprising the steps of coating the surface of a metal magnetic powder with tetrahydroxysilane or $Si(OH)_4$ and heating the powder to form an $SiO_2$ coating thereon, and a method of mixing the powder with the $SiO_2$ coating formed thereon with a binder in the form of synthetic resin, followed by pressing and heat treatment. The specification alleges that the $SiO_2$ coatings inhibit degradation of the interparticle insulation resistance and is able to be compressed; so the frequency characteristics of the core cannot be deteriorated even when the subsequent heat treatment is effected at an elevated temperature to increase the permeability of the core. In the example set forth in the specification, the alloy powders are first dipped in an alcohol solution of $Si(OH)_4$, and then heated at 250° C. to form $SiO_2$ coatings on the surfaces of the powders. Subsequently, the powders are compressed without or upon epoxy resin mixed therewith, and then heat treated at 500° to 900° C. This method wherein the particles are provided thereon with $SiO_2$ coatings and then compressed is distinguishable from the present invention making use of silicon resin and organic titanate. With such a method, therefore, it is impossible to improve interparticle insulation and the mechanical strength of the core at the same time, as achieved in the present invention.

JP-A 3(1991)-291305 discloses a method for making a soft magnetic alloy powder of shape anisotropy. In this method, mechanically pulverized alloy powders are mixed with 0.5 to 5.0% by weight of silicone oil, followed by heat treatment. The reason the powders are heat treated upon mixed with silicone oil is to prevent aggregation, of the powders by forming silicon oxide coatings from silicone oil, thereby expediting the subsequent disintegration and pulverization steps. In the example set forth in the specification, coarse powders are first wet ball-milled using stainless balls and ethanol to prepare flat powders consisting of a disk form of particles having a mean diameter of about 40 μm and a thickness of 1 μm. Then, the powders are mixed with silicone oil dissolved in toluene, dried, heated to 470° C. in the air, and finally heat treated at the maximum temperature of 500° to 900° C. In this example, it is believed that the formation of silicon oxide coatings from silicone oil occurs while the mixture is heated to 470° C. in the air. The specification is silent about the application of the thus produced soft magnetic alloy powders of shape anisotropy to a powder magnetic core. This method is used to form silicon oxide coatings for the purpose of preventing aggregation of alloy powders. Therefore, if the obtained powders should be used for powder magnetic core production, it is to be obvious that they make no contribution to an increase in the mechanical strength of the powder magnetic core.

BRIEF DESCRIPTION OF THE DRAWINGS

The present invention will now be explained more specifically but not exclusively with reference to the accompanying drawings, in which.

DETAILED EXPLANATION OF THE PREFERRED EMBODIMENTS

The present invention will now be explained at great length.

The powder magnetic core of the present invention is prepared by mixing together ferromagnetic metal powders and an insulating agent, and compressing and then annealing the mixture.

The ferromagnetic alloy powders used herein are made up of an alloy containing iron (Fe), aluminum (Al) and silicon (Si) predominantly at the sendust composition ratio. More particularly, the Al content lies in the range of preferably 3 to 10% by weight, more preferably 5 to 7% by weight, and the Si content lies in the range of preferably 5 to 13% by weight, more preferably 8 to 11% by weight with the balance being substantially Fe. Any departure of each element from the preferable range as above defined gives rise to a remarkable drop of permeability.

Figure 1:
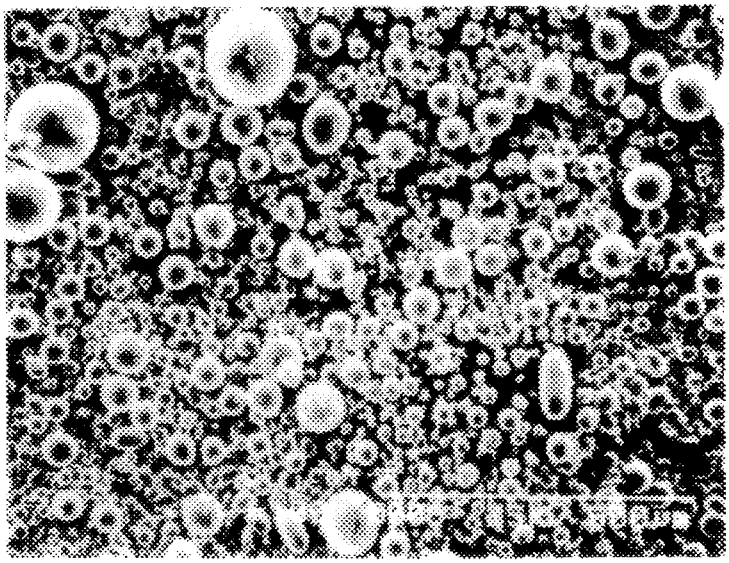
FIG. 1 is a scanning electron micrograph of sendust powders produced by gas atomization.

A ferromagnetic metal particle forming the ferromagnetic metal powder is in a substantially spherical form having a nearly flat surface, as shown in FIG. 1. Although depending on production methods, however, a plurality of spherical particles may often agglomerate into a larger particle. The powder-forming particle has a mean elongation (length/breadth) of preferably 1 to 3, more preferably 1 to 2. It is also preferable that this particle has no acute-angle portion of up to 30°. Too large a particle flakiness or amorphous particles make stress release by post-compressing annealing insufficient.

The weight mean particle diameter $D_{50}$ of the ferromagnetic metal powders lies in the range of preferably 15 to 65 μm, more preferably 30 to 55 μm. At too small a weight mean particle diameter $D_{50}$ it is required to increase the number of winding turns to obtain large inductance because there is a drop of permeability, and so copper (winding) losses increase with an increase in the amount of heat generated. At too large a $D_{50}$, on the other hand, there are large eddy-current losses. Here, the "weight mean particle diameter $D_{50}$" is understood to mean that the minimum to median ferromagnetic metal particles account for 50% by weight of the entire powders, as determined by a cumulative undersize distribution method.

In the present disclosure, a particle diameter $D_{10}$ means that undersize ferromagnetic metal particles account for 10% by weight of the entire ferromagnetic metal powders, and lies in the range of preferably 6 to 20 μm, more preferably 8 to 15 μm. Likewise, a particle diameter $D_{90}$ means that undersize ferromagnetic metal particles account for 90% by weight of the entire ferromagnetic metal powders, and lies in the range of preferably 25 to 100 μm, more preferably 50 to 90 μm. By use of ferromagnetic metal powders having such a particle size distribution it is possible to reduce eddy-current losses and to achieve high permeability as well.

To find $D_{10}$, $D_{50}$ and $D_{90}$, particle diameters may be measured by laser scattering techniques.

In the present invention, gas atomization is preferably used for ferromagnetic metal powder production. In gas atomization, a gas stream is jetted onto a melt form of the starting alloy that is flowing down from a nozzle, so that the melt can be scattered in droplets and cooled for solidification. For the cooling gas, non-oxidizing gases such as $N_2$ or Ar may be used to prevent oxidization of the powders. The conditions for gas atomization may be determined such that the ferromagnetic metal powders having the above-described properties are obtainable. By way of example alone, however, it is preferred that the temperature of the melt be 1,400° C. to 1,600° C. and the gas jetting pressure be 2.0 to 2.5 MPa. Gas atomization makes it easy to obtain a substantially spherical form of powders which are easily released from stresses by post-compressing annealing.

In the gas atomization process mentioned just above, the melt of the starting alloy is cooled down to room temperature in the gas. However, it is also preferable to use another gas atomization process wherein the melt of the starting alloy is scattered in droplets by the jetting of a gas, and the droplets or particles solidified to some extent are then cooled in a liquid. Even with this process it is possible to obtain a substantially spherical form of particles. For this process, however, it is preferred that droplets or particles be added dropwise to a liquid under agitation, especially in a mass of whirling cooling liquid, so that rapid and homogeneous cooling can be achieved by removing gases deposited on the droplets or particles being treated.

The powder magnetic core of the present invention is obtained by the compression of the above-mentioned ferromagnetic metal powders and insulating agent. Preferably but not exclusively, the insulating agent is silicone resin because it can stand up to annealing at high temperature and provide a core having an improved mechanical strength.

The silicone resin is an organopolysiloxane having an organosiloxane bond and refers, in a narrow sense, to an organopolysiloxane having a three-dimensional network structure. No particular limitation is imposed on the silicone resin used in the present invention, but the silicone resin in a narrow sense is necessarily used. The silicone resin in a narrow sense may be used in combination with silicone resin in a broad sense, for instance, silicone oil and silicone rubber. Preferably the silicone resin in a narrow sense should account for at least 50% by weight of the silicone resins used, and more preferably only the silicone resin in a narrow sense is used. Usually, the silicone resin is composed predominantly of dimethylpolysiloxane, but a part of the methyl groups may be substituted by other alkyl or aryl groups.

The ferromagnetic metal powders may be mixed with the solid or liquid silicone resin in the form of a solution, or may be directly mixed with the liquid silicone resin. However, it is preferable that the ferromagnetic metal powders be directly mixed with the liquid silicone resin, because when the silicone resin is used in a solution form, it is required to remove the solvent by drying prior to compression. The liquid silicone resin should have a viscosity of preferably 10 to 10,000 CP, more preferably 1,000 to 9,000 CP, as measured at 25° C. At too low or high a viscosity, difficulty is involved in forming homogeneous coatings on the surfaces of the ferromagnetic metal particles.

The amount of the silicone resin to be mixed with the ferromagnetic metal powders lies in the range of preferably 0.5 to 5% by weight, more preferably 1 to 3% by weight. When the amount of the silicone resin used is too small, the insulation among the ferromagnetic metal particles becomes insufficient; so does the mechanical strength of the core. When the amount of the silicone resin used is too large, the core has a non-magnetic area large enough to incur a drop of its permeability. When the amount of the silicone resin used is too small or too large, the density of the core tends to decrease.

The silicone resin, when used as the insulating agent, is mixed with a crosslinking agent in the form of organic titanate. By the combined use of the organic titanate the mechanical strength of the core can be much more increased.

The "organic titanate" used herein is understood to mean at least one crosslinking agent for the silicone resin, which is selected from the alkoxides and chelates of titanium.

The alkoxides may be monomers and/or oligomers. For the alkoxides, for instance, tetraalkoxytitanium having 1 to 8 carbon atoms is mentioned. More specifically, preference is given to tetra-i-propoxytitanium, tetra-n-butoxytitanium, and tetrakis(2-ethylhexoxy) titanium, among which tetra-i-propoxy-titanium and tetra-n-butoxytitanium are more preferable, and tetra-n-butoxytitanium is most preferable. In particular, preference is given to the oligomer or polymer of tetra-n-butoxytitanium represented by the following formula:

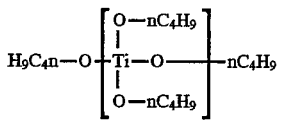

where n is an integer of preferably 10 or less, more preferably 2, 4, 7 or 10, most preferably 4. The larger the integer n, the lower the rate of the crosslinking reaction.

Preferably, the chelates include di-n-propoxy.bis (acetylacetonato)titanium, and di-n-butoxy.bis(triethanolaminato)titanium.

Among these organic titanate compounds, the above-described alkoxides are preferably used. These alkoxides can be directly mixed with the liquid silicone resin because of being liquid at normal temperature, have a suitable hydrolysis rate, and are easily available.

The amount of the organic titanate to be mixed with the silicone resin lies in the range of preferably 10 to 70% by weight, more preferably 25 to 50% by weight. When the amount of the organic titanate used is too small, the effect on a further increase in the mechanical strength of the core becomes insufficient. Use of too much organic titanate, on the other hand, makes no contribution to a remarkable increase in the mechanical strength of the core, and rather results in a drop of the permeability of the core.

Besides the silicone resin, it may be possible to use water glass or the like that is employed for conventional powder magnetic cores. However, it is here to be noted that the water glass, because of being decomposed at a temperature exceeding about 300° C. and so failing to maintain its own insulating properties, cannot be annealed at high temperature, and hence cannot be used for improving magnetic properties.

The mixture of the ferromagnetic metal powders and silicone resin should preferably be dried at a temperature of especially 50° to 300° C., more especially 50° to 150° C. At too low a drying temperature the ferromagnetic metal powders are likely to agglomerate into a mass because the adhesion of the silicone resin remains intact. Consequently, the ability of the ferromagnetic metal powders to be compressed becomes worse. At too high a drying temperature, on the other hand, the mechanical strength of the core is not improved to a sufficient level because the adhesion of the silicone resin becomes too low and makes no appreciable contribution to an increase in the mechanical strength of the core. The drying time, i.e., the period of time in which the mixture is passed through the above-described temperature zone or held at a certain temperature within the above-described temperature range should preferably be 0.5 to 2 hours. Too short a drying time fails to lower the adhesion of the silicone resin, whereas too long a drying time makes the adhesion of the silicone resin too low. The drying treatment, because of occurring at a relatively low temperature, need not be effected in a non-oxidizing atmosphere or may be done in the air.

Preferably, a lubricating agent should be added to the mixture upon dried and before compressed. The lubricating agent is used for enhancing interparticle lubrication during compression and the releasability of the compressed body from the mold. The lubricating agent may be selected from those ordinarily used for powder magnetic cores, for instance, from the group consisting of organic lubricants that are solid at normal temperature such as higher fatty acids, e.g., stearic acid, zinc stearate and aluminum stearate, or their salts or waxes, and inorganic lubricants such as molybdenum disulfide. The amount of the lubricant used varies with type. For instance, the organic lubricant that is solid at normal temperature may be used in an amount of preferably 0.1 to 1% by weight relative to the ferromagnetic metal powders, and the inorganic lubricant may be used in an amount of preferably 0.1 to 0.5% by weight relative to the ferromagnetic metal powders. The lubricant, when used in too small an amount, is less effective and, when used in too large an amount, gives rise to not only a drop of the permeability of the core but also a drop of the strength of the core.

Usually, the lubricating agent is mixed with the mixture upon dried. However, the lubricating agent, if it can stand up to heating for the drying treatment, may be added to the mixture before it is dried.

The mixture is then compressed or molded into any desired core shape. No particular limitation is placed on the core shape to which the present invention is applied. For instance, the present invention may be applied to the production of variously shaped cores inclusive of toroidal, EE, EI, ER, EPC, drum, pot and cup cores.

The compression conditions are not critical, and so may be determined depending on the desired core shape, core size, core density, etc. Usually, the maximum pressure applied may be about 6 to 20 t/cm$^2$, and the period of time in which the mixture is held at the maximum temperature may be about 0.1 second to 1 minute.

After compression, the compressed body is annealed to improve the magnetic properties of the core to be obtained. The annealing treatment is to release the ferromagnetic metal particles from stresses induced therein during their production and compression. The annealing treatment also enables the silicone resin to be cured to increase the density of the compressed body, so that the mechanical strength of the core can be improved.

The annealing conditions may be determined depending on the particle diameter and size distribution of the ferromagnetic metal powders, the compression condition, and so on. For instance, when the silicone resin and organic titanate are used, the annealing temperature is preferably 500° to 800° C., especially 600° to 760° C. At too low an annealing temperature the effect of annealing becomes insufficient, resulting in large hysteresis losses. Too high a temperature makes the ferromagnetic metal powders likely to sinter; so the insulation among the ferromagnetic metal particles degrades, resulting in large eddy-current losses. The annealing time, i.e., the period of time in which the compressed body is passed through the above-described temperature zone or held at a certain temperature within the above-described temperature range is preferably 10 minutes to 1 hour. Too short an annealing time makes the effect of annealing insufficient, whereas too long makes the ferromagnetic metal powders likely to sinter.

Preferably, the annealing treatment should be effected in a non-oxidizing atmosphere so as to prevent oxidization of the ferromagnetic metal powders. When the silicone resin and organic titanate are used and the annealing treatment is done in a non-oxidizing atmosphere, the resulting core usually contains the silicone resin and organic titanate. This can be confirmed by analysis methods such as FT-IR (Fourier transform infrared spectroscopy) transmission methods.

According to the present invention, the lattice strains of the ferromagnetic metal particles in the core upon annealed can be reduced to 10% or less. Large lattice strains give rise to large hysteresis losses.

Lattice strain in a ferromagnetic metal particle is found by x-ray diffraction analysis in the following way. If a crystallite contains a local strain, the lattice spacing is variable so that the breadth of the diffracted beam becomes large. The larger the angle of diffraction (Bragg angle), the more pronounced this effect. Thus, lattice strain in a crystallite can be found by making examination of the dependence of the diffracted beam on the angle of diffraction. More specifically, a modified Hall's analysis method is used. In this method crystallite size is calculated apart from lattice strain. Here let $\beta p$, $\beta s$, and $\beta$ denote the spread of the diffracted beam due to crystallite size alone, the spread of the diffracted beam due to lattice strain, and the spread of the diffracted beam inherent in the specimen. Then, $$\beta p/\beta=1-(\beta s/\beta)^2 \quad (1)$$

$$\beta p=\lambda/(\xi\cdot\cos\Theta) \quad (2)$$

$$\beta s=2\eta\cdot\tan\Theta \quad (3)$$

Here, $\xi$ is the size of the crystallite, $\lambda$ is the wavelength of x-rays, $\Theta$ is the Bragg angle, and $\eta$ is the lattice strain. Substitution of Eqs. (2) and (3) into Eq. (1) gives $$\beta^2/\tan^2\Theta=(\lambda/\xi)(\beta/\tan\Theta)\sin\Theta+4\eta^2 \quad (4)$$

With $\beta^2/\tan^2\Theta$ plotted on the y axis and $(\lambda\beta/\tan\Theta)\sin\Theta$ plotted on the x axis, the gradient of the straight line is given by $1/\xi$, and the y-intercept becomes $4\eta^2$ upon extrapolated into $(\lambda\beta/\tan\Theta)\sin\Theta=0$. In the ferromagnetic metal particle used in the present invention, the crystallite is of an almost constant size and of large-enough magnitude. Now suppose $1/\xi$ nearly equal to 0. Then, the lattice strain is found by $$\beta^2/\tan^2\Theta=4\eta 2$$

For the diffracted beam, the beam diffracted by the (422) plane in the vicinity of $2\Theta=82.2°$ is used because the detection sensitivity for lattice strains is increased.

In the present invention, the coercive forces of the ferromagnetic metal particles in the core upon annealed can be reduced to 0.35 Oe or lower or in some cases 0.25 Oe or lower. Large coercive forces are tantamount to large hysteresis losses.

If required, the core is provided with an insulating film and windings upon annealed. The core, when prepared in halves, is finished into a complete one, encased, and so on.

The powder magnetic core of the present invention can have a permeability of at least 50 and in some cases at least 100, as measured at 100 kHz. The powder magnetic core can also have a core loss at 100 kHz of up to 450 kW/m$^3$ and in some cases up to 200 kW/m$^3$ in an applied magnetic field of 100 mT. Moreover, it can have a core loss at 25 kHz of up to 300 kW/m$^3$ and in some cases up to 200 kW/m$^3$ in an applied magnetic field of 200 mT.

The present invention will now be explained in more detail with reference to some examples.

EXAMPLE 1

First, the following ferromagnetic metal powders were prepared.

Gas Atomized Sendust Powders

Powders of sendust (5.9 wt % Al-9.8 wt % Si-Fe) were prepared by gas atomization. The $D_{50}$, $D_{10}$ and $D_{90}$ of these powders were 40 μm, 11 μm and 85 μm, respectively. Attached hereto as FIG. 1 is a scanning electron micrograph of the powders.

Pulverized Sendust Powders

Figure 2:
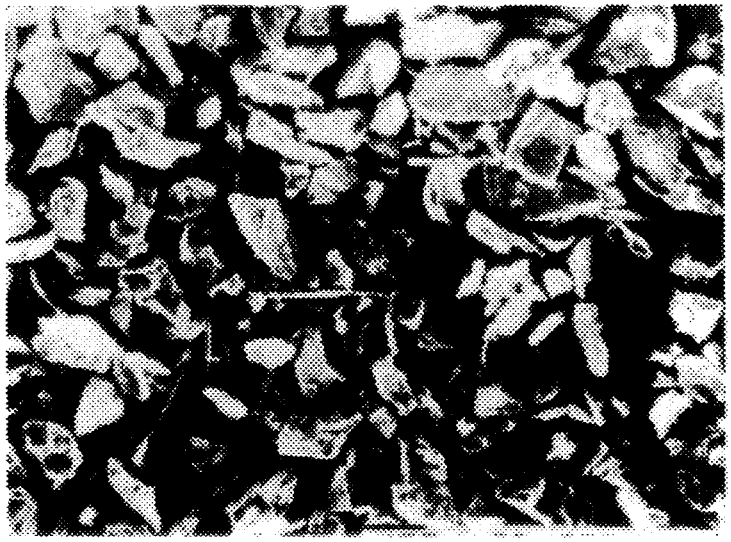
FIG. 2 is a scanning electron micrograph of sendust powders produced by the pulverization of an ingot obtained by melting and casting.

An ingot produced by melting and casting was pulverized and powdered by a jaw crusher, a Brownian mill and a vessel mill. Thereafter, the powders were annealed at 900° C. for 1 hour in a hydrogen atmosphere. Powder composition was the same as that of the above gas atomized powders. The $D_{50}$, $D_{10}$ and $D_{90}$ of these powders were 38 μm, 10 μm and 88 μm, respectively. Attached hereto as FIG. 2 is a scanning electron micrograph of the powders.

Water Atomized Mo Permalloy Powders

Powders of an 81 wt % Ni-2 wt % Mo-Fe alloy were prepared by water atomization. The $D_{50}$, $D_{10}$ and $D_{90}$ of the powders were 30 μm, 8 μm and 38 μm, respectively.

Each of the above three types of powders was mixed with a silicone resin and organic titanate in an automatic mortar, followed by a 1-hour drying at 100° C. For the silicone resin use was made of a solvent-free type silicone resin (SR2414 made by Toray Silicone Industries, Inc., and having a viscosity of 2,000 to 8,000 CP at 25° C.), and for the organic titanate use was made of the compound represented by the above-described formula (1) where n=4 (TBT Polymer B-4 made by Nippon Soda Co., Ltd.). The amount of the silicone resin mixed with the ferromagnetic metal powders was 1.8% by weight, and the amount of the organic titanate added to the silicone resin was 33% by weight.

A lubricating agent was added to the mixture upon dried. For the lubricating agent, zinc stearate was used in an amount of 0.4% by weight relative to the ferromagnetic metal powders.

The thus dried mixture was then pressed into a toroidal body having an outer diameter of 17.5 mm, an inner diameter of 10.2 mm and a height of 6 mm. In this case, the mixture was pressed at a pressure of 10 t/cm$^2$ for 10 seconds.

Then, the compressed body was annealed at 700° C. for 0.5 hours in an Ar atmosphere to obtain a toroidal core.

Each of the thus prepared cores was measured for the initial permeability (μi) at 100 kHz as well as for hysteresis (Ph), eddy-current (Pe) and core (Pt) losses at 100 kHz and 100 mT and at 25 kHz and 200 mT, respectively. The results are set out in Table 1 wherein Pt=Ph+Pe.

X-ray diffraction analysis of core Nos. 101 and 102 was made to find lattice strains by the above-described method using the diffracted beams from the (422) planes. Core Nos. 101 and 102 were also measured for coercive forces, using a VSM. Furthermore in this case, the lattice strains and coercive forces of the ferromagnetic metal powders prior to compression and the compressed bodies prior to annealing were measured. The results are set out in Table 1.

TABLE 1

| Core No. | Ferro-magnetic Metal Powders | μi 100 Hz | Losses (kW/m$^3$) 100 kHz, 100 mT Ph | Pe | Pt | 25 kHz, 200 mT Ph | Pe | Pt |
|---|---|---|---|---|---|---|---|---|
| 101 | Sendust* | 70 | 220 | 160 | 380 | 128 | 110 | 238 |
| 102 | Sendust** | 70 | 810 | 150 | 960 | 455 | 105 | 560 |
| 103 | Permalloy* | 60 | 590 | 410 | 1000 | 320 | 260 | 580 |

Core Nos. 102 and 103 are for comparative purposes.
Sendust* is the gas atomized sendust powders.
Sendust** is the pulverized sendust powders.
Permalloy* is the water atomized Mo permalloy powders.

TABLE 1'

| Core No. | Lattice Strain (%) Powders | Compact | Annealed | Coercive Force (Oe) Powders | Compact | Annealed |
|---|---|---|---|---|---|---|
| 101 | 14.78 | 29.48 | 8.54 | 0.77 | 2.51 | 0.18 |
| 102 | 9.69 | 28.67 | 10.09 | 0.46 | 2.78 | 0.50 |
| 103 | — | — | — | — | — | — |

Core Nos. 102 and 103 are for comparative purposes.

As can be seen from Table 1, core No. 101 obtained using the gas atomized sendust powders according to the present invention has a permeability of at least 50 at 100 kHz, a core loss of 450 kW/m$^3$ or lower at 100 kHz in the applied magnetic field of 100 mT, and a core loss of 300 kW/m$^3$ or lower at 25 kHz in the applied magnetic field of 200 mT. However, comparative core No. 102 obtained using the pulverized sendust powders has been annealed, yet its hysteresis loss is much larger than that of core No. 101. Comparative core No. 103 obtained using Mo permalloy known to be a low-loss material is larger in terms of both hysteresis and eddy-current losses than core No. 101. Both core Nos. 102 and 103 show core losses exceeding 450 kW/m$^3$ at 100 kHz and 100 mT, and core losses exceeding 300 kW/m$^3$ at 25 kHz and 200 mT.

EXAMPLE 2

Gas atomized sendust powders with the particle size distribution shown in Table 2 were obtained under varying gas atomization conditions. As in Example 1, these powders were formed into toroidal cores, the properties of which were then measured as in Example 1. The results are set out in Table 2 in which the results of core No. 101 are also shown.

TABLE 2

| Core No. | Particle Size Distribution (μm) $D_{50}$ | $D_{10}$ | $D_{90}$ | μi 100 Hz | Losses (kW/m3) 100 kHz, 100 mT Ph | Pe | Pt | 25 kHz, 200 mT Ph | Pe | Pt |
|---|---|---|---|---|---|---|---|---|---|---|
| 201 | 25 | 9 | 40 | 60 | 140 | 35 | 175 | 120 | 30 | 150 |
| 101 | 40 | 11 | 85 | 70 | 220 | 160 | 380 | 128 | 110 | 238 |
| 202 | 70 | 25 | 110 | 82 | 240 | 540 | 780 | 145 | 230 | 375 |

From Table 2, it is understood that when the gas atomized sendust powders have the preferable particle size distribution as already mentioned, eddy-current losses decrease drastically with a decrease in core losses.

EXAMPLE 3

Figure 3:
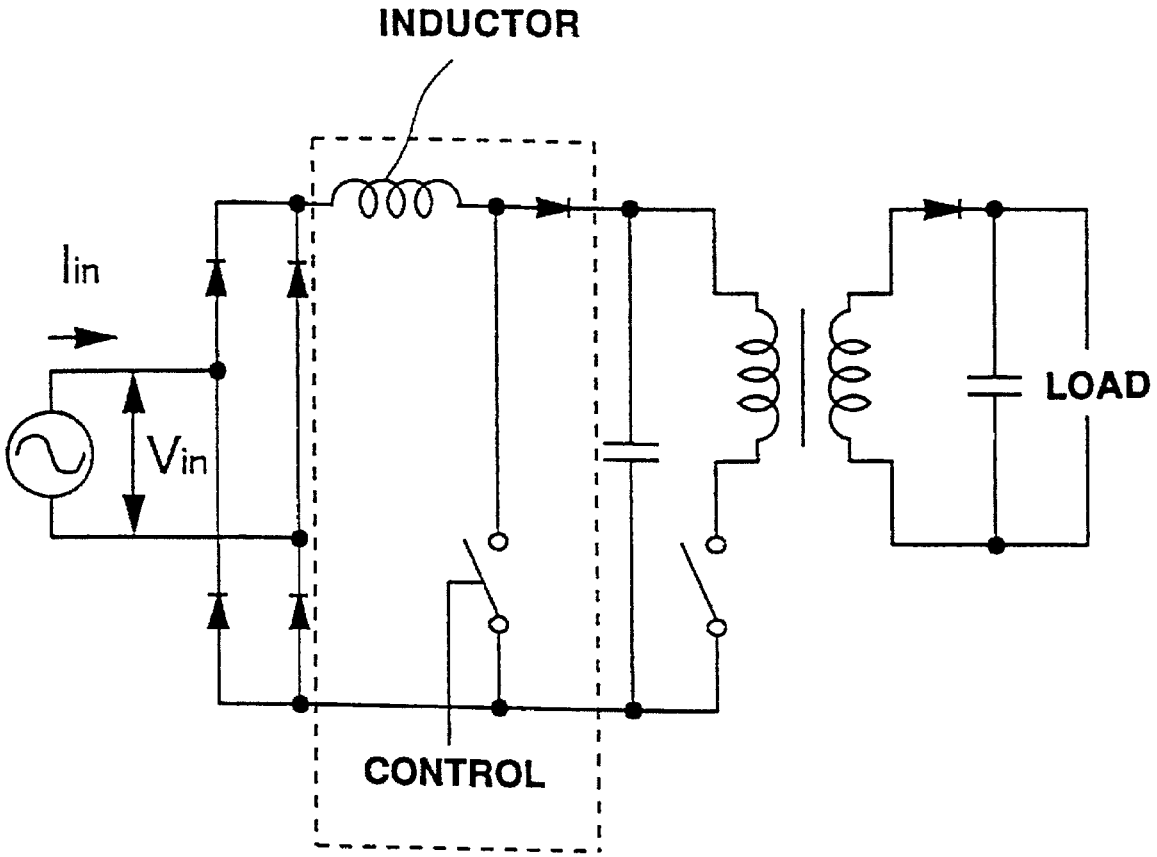
FIG. 3 is one exemplary circuit diagram including a power factor-improving circuit.

Each of the three cores prepared in Example 1 was mounted as an inductor for a circuit substrate including a power factor-improving circuit, as shown in FIG. 3, thereby measuring a temperature rise of the core at an output of 200W and 100 kHz. The results are set out in Table 3.

TABLE 3

| Core No. | Ferromagnetic Metal Powders | Temp. Rise (°C.) |
|---|---|---|
| 101 | Gas Atomized Sendust | 38 |
| 102 (Comp.) | Pulverized Sendust | 59 |
| 103 (Comp.) | Water Atomized Mo Permalloy | 65 |

For electronic components, it is generally required to limit their temperature rise during use to 50° C. or lower, preferably 40° C. or lower. As can be seen from Table 3, the core of the present invention conforms to this requirement. It is thus found that the powder magnetic core of the present invention is applicable even to fields where conventional powder magnetic cores having large core losses cannot be used.

EXAMPLE 4

As in the case of core No. 101 in Example 1, toroidal cores were fabricated with the exception that the compressed body annealing temperature was changed as shown in Table 4. Losses Ph, Pe and Pt of these cores were found at 100 kHz and 100 mT. The results are set out in Table 4.

TABLE 4

| | Annealing | Losses (kW/m$^3$) at 100 kHz and 100 mT | | |
|---|---|---|---|---|
| Core No. | Temp (°C.) | Ph | Pe | Pt |
| 401 | 550 | 750 | 160 | 910 |
| 402 | 650 | 290 | 160 | 450 |
| 403 | 750 | 210 | 170 | 380 |

From Table 4 it is found that large losses occur at the annealing temperature of 550° C. However, core No. 202 in Table 2 that was made up of powders with a small $D_{50}$ value showed a core loss of 450 kW/m$^3$ or lower at 100 kHz and 100 mT and a core loss of 300 kW/m$^3$ or lower at 25 kHz and 200 mT, even when annealed at 550° C.

The results of x-ray diffraction analysis indicated that the sendust powders upon annealed according to the above examples have all a $DO_3$ structure.

For the purpose of comparison, a toroidal core was prepared using a mixture of water glass and glass powders as an insulating agent. A mixture of water glass and glass powders is a material having heat resistance higher than that of water glass alone. The glass powder used was $PbO$-$SiO_2$-$B_2O_3$ having a mean particle diameter of 3 μm and a softening point of 430° C., and the water glass and glass powder were each used in an amount of 1.5% by weight relative to the ferromagnetic metal powders. First, the glass powders were dispersed in the water glass to prepare an insulating agent solution. Then, this insulating agent solution was mulled with the gas atomized sendust powders obtained in Example 1, which were in turn dried and disintegrated. After a lubricating agent was added to the product, the product was compressed and annealed as already mentioned, obtaining a toroidal core. The core, when annealed at 500° C. or higher, showed a core loss of 1,500 kW/m$^3$ or more at 100 kHz and 100 mT, indicating that the insulation among the ferromagnetic metal particles breaks down. The core, when annealed at 450° C., showed a diametrical breaking strength of 4 kgf, whereas toroidal core No. 101 in Table 1 had a diametrical breaking strength as high as 25 kgf. This strength difference is obviously obtained by the combined use of the silicone resin and organic titanate. The diametrical breaking strength is here understood to refer to the force applied to a toroidal core in the diametrical direction until it breaks down.

Toroidal core No. 101 in Table 1 was pulverized for Soxlet extraction with chloroform. The chloroform was then evaporated off for FT-IR transmission analysis. Consequently, characteristic bands of the organic titanate were found at 2960 cm$^{-1}$, 2930 cm$^{-1}$ and 2870 cm-1 (all due to C-H stretching vibration), and 1460 cm$^{-1}$ and 1370 cm$^{-1}$ (all due to C-H deformation vibration). A broad peak was also found at 1120 to 1030 cm$^{-1}$, and this appears to be because the polymeric property of the silicone resin has been further enhanced. These results teach that the core upon annealed contains the silicone resin and organic titanate.

Japanese Patent Application No. 6(1994)-192207 is incorporated herein by reference.

What is claimed is:

1. A powder magnetic core prepared by a process comprising the steps of compressing a ferromagnetic metal powder and an insulating agent and then annealing the resulting compressed body, wherein said ferromagnetic metal powder comprises ferromagnetic metal particles having a length/breadth ratio of between 1 and 3, said ferromagnetic metal particles comprising an alloy of iron, aluminum and silicon, wherein the powder magnetic core has a permeability of at least 50 at 100 kHz, a core loss of up to 450 kW/m$^3$ at 100 kHz in an applied magnetic field of 100 mT, and a core loss of up to 300 kW/m$^3$ at 25 kHz in an applied magnetic field of 200 mT.

2. The powder magnetic core according to claim 1, wherein said ferromagnetic metal particles have a weight mean particle diameter $D_{50}$ of 15 to 65 μm, as determined by a cumulative undersize distribution method.

3. The powder magnetic core according to claim 2, wherein said ferromagnetic metal particles have a weight mean particle diameter $D_{10}$ of 6 to 20 μm and a weight mean particle diameter $D_{90}$ of 25 to 100 μm, as determined by a cumulative undersize distribution method.

4. The powder magnetic core according to any one of claims 1–3, wherein lattice strain in the annealed ferromagnetic metal particles contained in the powder magnetic core is 10% or less.

5. The powder magnetic core according to claim 1, wherein the ferromagnetic metal particles contained in the powder magnetic core have a coercive force of up to 0.35 Oe.

6. The powder magnetic core according to claim 1, wherein said ferromagnetic metal powder has been produced by gas atomization.

7. The powder magnetic core according to claim 1, wherein said insulating agent is a mixture of silicone resin and organic titanate.

8. The powder magnetic core according to claim 7, wherein the annealing step is carried out at a temperature of 500° to 800° C.

9. The powder magnetic core according to claim 1, wherein the ferromagnetic metal particles have a length/breadth ratio of between 1 and 2.

* * * * *